United States Patent [19]

Bick

[11] Patent Number: 4,650,038

[45] Date of Patent: Mar. 17, 1987

[54] RETARDERS SUITABLE FOR WAGON SPEED CONTROL

[75] Inventor: David E. Bick, Newent, England

[73] Assignee: Dowty Hydraulic Units Limited, Cheltenham, England

[21] Appl. No.: 729,263

[22] Filed: May 1, 1985

[30] Foreign Application Priority Data

May 12, 1984 [GB] United Kingdom ..... 8412211

[51] Int. Cl.[4] ..... B61K 7/02

[52] U.S. Cl. ..... 188/62; 104/26.2

[58] Field of Search ..... 188/62, 63, 32, 265, 188/38.5, 300; 104/26 A, 162; 267/8 R, 8 B

[56] References Cited

U.S. PATENT DOCUMENTS

| | | | |
|---|---|---|---|
| 3,040,676 | 6/1962 | Checkley et al. | 188/62 |
| 3,148,633 | 9/1964 | Bick et al. | 188/62 |
| 3,637,052 | 1/1972 | Bick | 188/62 |
| 4,535,872 | 8/1985 | Bick et al. | 188/62 |

*Primary Examiner*—Duane A. Reger
*Assistant Examiner*—James E. Barlow
*Attorney, Agent, or Firm*—Hayes, Davis & Soloway

[57] ABSTRACT

A retarder, suitable for mounting with respect to a rail of a railway track for reducing the speed of a wagon rolling along the track, includes an hydraulic unit a portion of which, for retardation of the wagon, is disposed in the path of a wheel of the wagon. That portion when engaged, directly or indirectly, by the wheel is deflected by, and out of the path of, the wheel. A thruster device, disposed alongside the unit and capable also of deflecting the portion out of the path, includes a displaceable element which is normally disengaged from the portion but which upon initial movement thereof is so tilted that a part thereof comes into driving engagement with the portion. On continued movement of the element the driving engagement is maintained and the portion moves from its position in the path of the wheel into another position out of the path.

14 Claims, 4 Drawing Figures

RETARDERS SUITABLE FOR WAGON SPEED CONTROL

Figure 1:
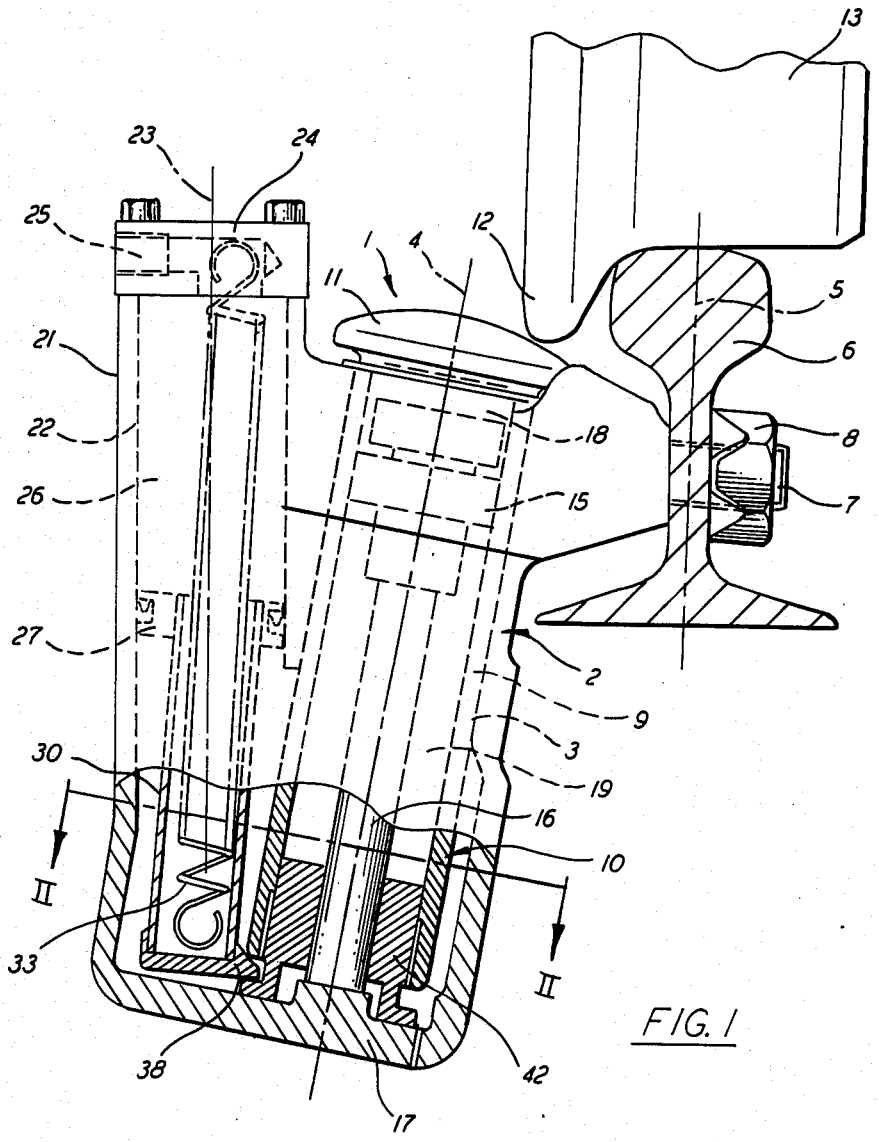

This invention relates to retarders of the kind suitable for reducing the speed of a wagon in which the movement of a wheel of the wagon, for example along a rail of a railway track, is opposed by an hydraulic device acting against the periphery of the wheel.

Hitherto, certain such retarders have comprised a retainer, securable to a rail of a railway track, and an hydraulic unit removably inserted in the retainer, a portion of the unit being deflectable in a vertical or generally vertical direction by the periphery of a wheel rolling along the rail. Such a retarder is the subject of U.S. Pat. No. 3,637,052 and has particular application in railway marshalling yards, for example for use in retarding wagons being shunted into sidings.

However, when hitherto a cut of wagons has been moved by a locomotive or other traction means out from a siding equipped with such retarders, wheels of all the wagons have engaged all the retarders, momentarily and successively deflecting said portions of the hydraulic units of all of them. Such engagement and the consequential rapid reciprocation of those portions have resulted in the generation of considerable noise which has been undesirable environmentally particularly where the marshalling yards are sited in or near highly populated areas.

The invention as claimed is intended to provide a remedy. It solves the problem of how to design retarders in which the generation of such noise is at least substantially reduced when wagons are so moved out from a siding, and provides improved means for controlling those retarders.

According to this invention a retarder, suitable when mounted upon or adjacent a rail of a railway track for reducing the speed of a wagon rolling along said track, includes an hydraulic unit a portion of which, for retardation of said wagon, is disposed in the path of a wheel of said wagon, said portion when engaged, directly or indirectly, by a said wheel being deflected by, and out of the path of, said wheel to permit the wheel to pass the retarder, and thruster means, disposed alongside said unit and capable also of deflecting said portion out of said path, said thruster means having a displaceable element which is normally disengaged from said portion of said unit but which upon initial movement thereof, under a force applied thereto, is so tilted that a part thereof comes into driving engagement with said portion and on continued movement of said element said driving engagement is maintained and said portion is moved from its position in the path of said wheel into another position out of said path.

Preferably said retarder includes a retainer arranged for fitment to said rail and in this case said hydraulic unit is fitted in said retainer, said portion thereof normally projecting from the retainer into said path of a wheel and being movable in a direction inwardly of said retainer by said wheel when coming into engagement, directly or indirectly, with said portion.

The said thruster means may be of piston-and-cylinder type, and in this case the cylinder thereof may be formed integrally with said retainer and may be disposed with its longitudinal axis inclined to the longitudinal axis of said hydraulic unit.

The piston of said thruster means may be provided with a piston rod, said piston and rod forming said displaceable element and the axis of said piston rod being parallel to, and substantially offset from, the longitudinal axis of said piston. Preferably the free end of said piston rod has an upstanding formation which forms said part capable of coming into driving engagement with said portion of said hydraulic unit.

The upstanding formation may be engageable with an annular groove formed in the exterior surface of said portion of said hydraulic unit or an extension member carried by that portion.

The piston rod may be hollow and a tension spring may be partly housed therein. The spring is preferably secured at one end to the end of the piston rod remote from the piston and passes through said piston so that at its other end it is secured to an end wall of the cylinder at a point offset from the longitudinal axis of the cylinder.

The thruster means may be operable under fluid pressure, for example compressed air, derived from a suitable source.

One advantage offered by the invention is that when, for retardation of a wagon, the retarder is extended in the path of the wagon wheels, the thruster means which is then in its inoperative condition is completely disengaged from the hydraulic unit of the retarder, permitting the hydraulic unit to be contracted, as the wagon wheel passes over it, without any accompanying movement of the displaceable element of the thruster means which might otherwise impair smooth operation of the retarder.

Figure 2:
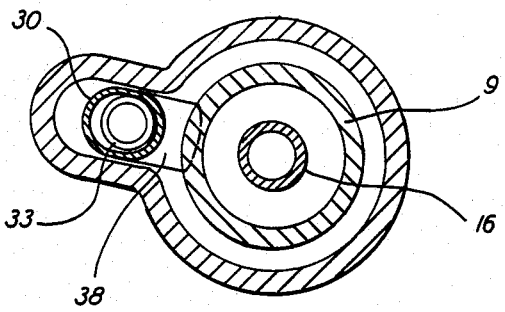
Figure 3:
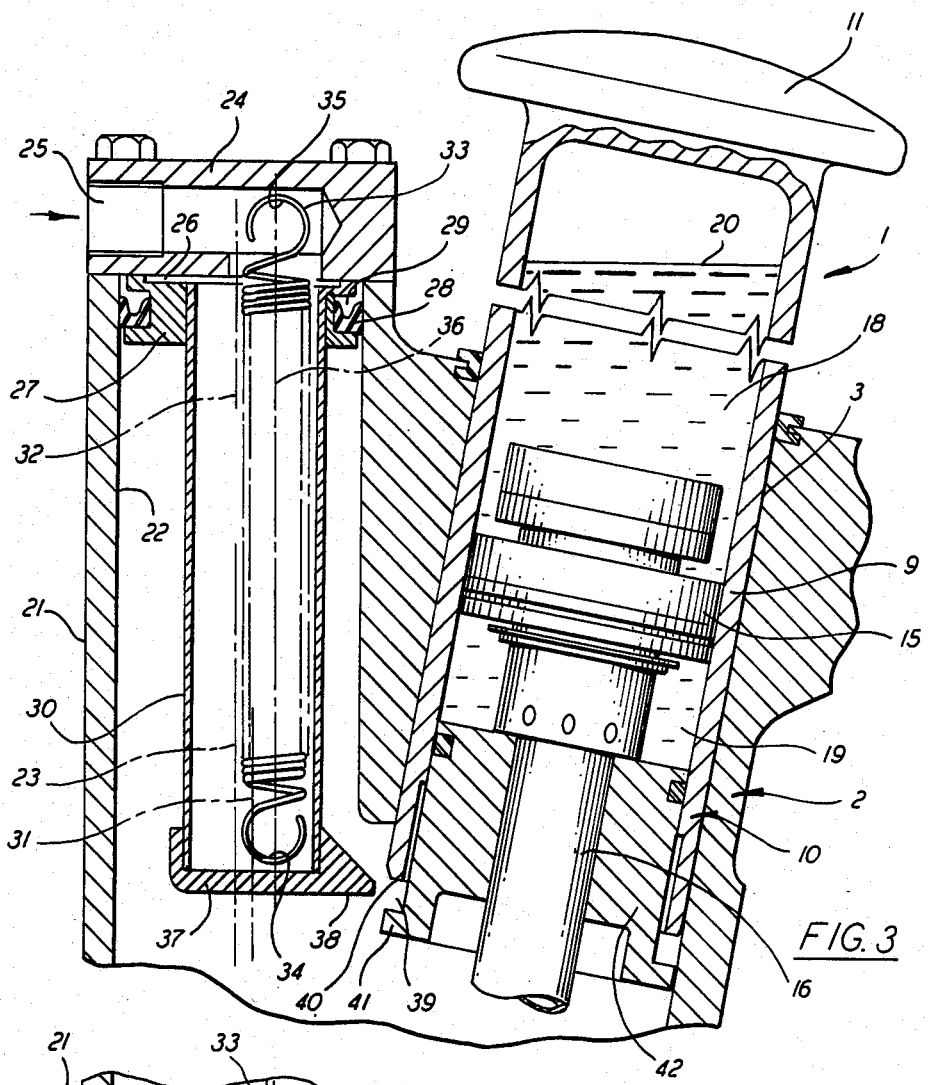
Figure 4:
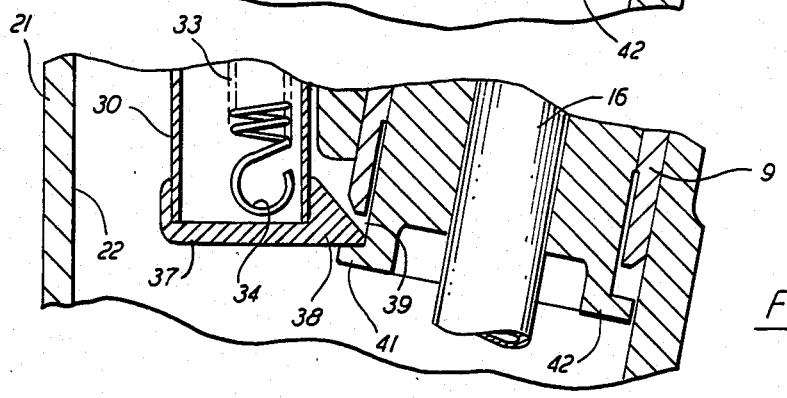

One way of carrying out the invention is described in detail below with reference to drawings which illustrate only one specific embodiment, in which FIG. 1 is a part-sectional side elevation of a retarder fitted to a rail of a railway track, FIG. 2 is a cross-section taken along the line II—II on FIG. 1, FIG. 3 is an enlarged cross-sectional side elevation of a part of the retarder shown in FIG. 1, and FIG. 4 is a reproduction of the lower part of FIG. 3, but with the thruster means in engagement with the movable portion of the retarder.

The figures show a retarder 1 which comprises a retainer 2 having a bore 3 which is open at its upper end and which is blind at its lower end. The axis 4 of bore 3 is inclined as shown to the vertical plane 5 of a rail 6 of a railway track in a siding. The retainer is secured to the inner side face of that rail by two studs and two nuts, one of each of which is shown in FIG. 1 at 7 and 8 respectively. A cylinder 9 forming one portion of an hyraulic unit 10 of the retarder is slidable and rotatable in bore 3, the longitudinal axis of unit 10 being coincident with axis 4. The upper end portion of the cylinder is flanged and domed, as at 11, and is engageable by the flange 12 of a wagon wheel 13 when that wheel is rolling along rail 6 and over retarder 1.

In a manner similar to the construction described in the specification of U.S. Pat. No. 3,637,052, a piston 15 is slidable in cylinder 9. This piston is integral with or otherwise secured to a piston rod 16 having a diameter which is small compared with that of bore 3. The rod 16 engages the lower end wall 17 of retainer 2 and the piston divides the interior of cylinder 9 into two chambers 18, 19. The cylinder contains hydraulic liquid up to a desired level 20 in chamber 18. Beyond that level chamber 18 contains gas, for example nitrogen, which is compressed to act as a spring for effecting telescopic extension of cylinder 9 with respect to bore 3.

Further, in the manner as also described in the above-mentioned specification, hydraulic unit 10, formed by cylinder 9 and its piston 15 and piston rod 16, is provided with valve means (not shown).

This valve means is capable of restricting the flow of liquid from one side of the piston to the other side thereof during telescopic deflecting movement of the cylinder, by a wagon wheel, with respect to the piston and its rod. The gas spring provides a return force on the cylinder to tend to return it to its normal position in which it projects into the path of a wheel.

The retainer 2 is so shaped as to have a subsidiary portion 21 or cylinder formed integrally therewith on that side thereof remote from the studs 7. This portion 21 is provided with a bore 22 the axis 23 of which is so inclined with respect to axis 4 of bore 3 as to be approximately parallel to plane 5 of rail 6 and thus bore 22 is substantially vertically-disposed.

The bore 22 is closed at its upper end by a cover plate 24 which incorporates a connection 25 through which compressed air from a suitable source (not shown) can be introduced to chamber 26 above a piston 27 which is slidable in bore 22. The piston is provided with a sealing ring 28, of channelled cross-section, housed in an annular groove 29 and sealingly engaging the wall of bore 22.

Piston 27 is provided with a hollow piston rod 30 extending downwardly therefrom. The longitudinal axis 31 of rod 30 is parallel to, and substantially offset from, the longitudinal axis 32 of piston 27. A tension coil spring 33 is partly housed within rod 30, being secured at 34 at its lower end to the lower end portion of the rod and passing upwardly through the open upper end portion of the rod for connection at 35 at the position shown offset from axis 23 within the cover plate 24. With the spring in its unstretched condition it lies with its longitudinal axis 36 substantially parallel to the longitudinal axis 23 of bore 22 and substantially offset therefrom in the direction towards unit 10.

The lower end of rod 30 is closed by a closure member 37 with which an upstanding formation 38, of the profile more clearly shown in FIGS. 3 and 4, is integrally formed. The formation 38 is co-operable with an annular groove 39 formed between the lower end face 40 of cylinder 9 and a flange 41 extending radially-outwardly from the lower extremity of cylinder closure member 42 through which rod 16 passes.

The subsidiary portion 21, spring 33, piston 27 and rod 30 thus form thruster means which is extendible under compressed air supplied to chamber 26 through connection 25.

In operation, when for example a cut of wagons is to be shunted into a siding, and is required to be subjected to deceleration by a number of the retarders suitably positioned along the rail 6 of the track in the siding, the thruster means is not supplied with compressed air and thus each piston 27 and its rod 30 are in the uppermost position as shown in FIG. 3. Also the cylinder 9 of each retarder is in its uppermost position in which it lies in the path of the flanges 12 of oncoming wagon wheels. As each of the wagon wheels passes over an hydraulic unit of each retarder at a speed greater than a predetermined value, wagon kinetic energy will be dissipated in the manner disclosed in the specification of the above-mentioned U.S. Pat. No. 3,637,052, and wagon speed will be reduced accordingly so that the cut of wagons thereafter comes to rest in the siding.

When, however, it is required to move the cut of connected wagons by suitable traction means out from that siding and across points onto a main line, the chambers 26 of the thruster means 21, 33, 27, 30 of all the retarders are charged with compressed air by way of their connections 25. Since each spring 33, now in the condition shown in FIG. 3, is disposed in a position offset from the axis 23 of its respective bore 22, initial movement of the displaceable element, formed by piston 27 and rod 30, under the compressed air now present in chamber 26 is a tilting movement. Further, since the offsetting of the spring away from axis 23 is in the direction towards hydraulic unit 10, this initial tilting movement of piston 27 and rod 30 is such that the upstanding formation 38 swings to the right in FIG. 3 and engages groove 39. This tilting movement, under the constraint of spring 33, is permitted by the predetermined clearance between piston 27 and its bore and by the inherent resilience of sealing ring 28.

Thus as piston 27 and rod 30 thereafter move downwardly in their tilted attitude, formation 38 is maintained in positive driving engagement with groove 39, and cylinder 9 is thus caused to move downwardly in bore 3, hydraulic unit 10 thereby contracting. This movement continues, pushing cylinder 9 further downwardly, until piston 27 and rod 30 reach the position shown in FIG. 1 and unit 10 is fully contracted. During this downward movement and due to the converging disposition of axes 4 and 23, piston 27 and rod 30 are constrained to reverse their direction of tilting somewhere around mid-stroke, but nevertheless positive driving engagement of upstanding formation 38 with groove 39 is maintained to the fully-lowered position of the piston and rod.

The compressed air pressure is maintained in the chambers 26 of all the retarders to permit the wagons to pass out from the siding, the wheels of the wagons then passing over the retarders relatively quietly because the flanges 11 of cylinders 9 lie completely out of the path of the flanges 12 of the wheels.

When the cut of wagons has moved completely out from the siding the supply of compressed air to the chambers 26 of all the thruster means is switched off, whereupon the hydraulic units 10 are permitted to re-extend so that the flanges 11 are again disposed in the path of the flanges of the wheels of the next cut of wagons required to enter the siding and to be decelerated. Simultaneously with such re-extension of each hydraulic unit 10 the respective piston 27 and rod 30 move upwardly to the position shown in FIG. 3, the upstanding formation 38 becoming disengaged from groove 39 as tension in spring 33 reduces either to zero, or to a relatively low predetermined value, at the final stage of upward movement of the piston and rod. Thus the displaceable element formed by the piston and rod becomes completely free from cylinder 9 and the subsequent deflection of the cylinder by a wheel for wagon retardation is not accompanied by movement of the displaceable element of the thruster means which might otherwise impair smooth operation of the retarder. However the thruster means can then be subjected to relatively low pneumatic pressure so that once the wheel has caused full deflection of cylinder 9 the thruster means is automatically effective to move the formation 38 into engagement with groove 39, thus operating as a latch to hold the cylinder in its lowered condition until the low pneumatic pressure in the thruster means is subsequently released.

Although in the embodiment above described with reference to the drawings the thruster means is operable by compressed air, in alternative embodiments of the invention the thruster means may be suitably hydraulically-operable, electrically-operable or vacuum-operable.

Finally, although in the embodiment above described with reference to the drawings the wheel 13 is directly engageable with cylinder 9, in alternative embodiments of the invention the wheel may be engageable with that cylinder through the intermediary of a further member, for example a suitably-shaped head member or alternatively a lever member pivotally-mounted upon or adjacent the track.

I claim:

1. A retarder, suitable when mounted upon or adjacent a rail of a railway track for reducing the speed of a wagon rolling along said track, including a hydraulic unit a portion of which, for retardation of said wagon, is disposed in the path of a wheel of said wagon, said portion when engaged, directly or indirectly, by a said wheel being deflected by, and out of the path of, said wheel to permit the wheel to pass the retarder, and thruster means, disposed alongside said unit and capable also of deflecting said portion out of said path, said thruster means being disposed with its longitudinal axis inclined with respect to the longitudinal axis of the hydraulic unit and having a displaceable element which is normally disengaged from said portion of said unit but which upon initial movement thereof, under the force applied thereto, is so tilted that a part thereof comes into driving engagement with said portion and on continued movement of said element said driving engagement is maintained and said portion is moved from its position in the path of said wheel into another position out of said path.

2. A retarder as claimed in claim 1 and including a retainer arranged for fitment to said rail.

3. A retarder as claimed in claim 2, wherein said hydraulic unit is fitted in said retainer, said portion thereof normally projecting from the retainer into said path of a wheel and being movable in a direction inwardly of said retainer by said wheel when coming into engagement, directly or indirectly, with said portion.

4. A retarder as claimed in claim 2, wherein said thruster means is of piston-and-cylinder type.

5. A retarder as claimed in claim 4, wherein the cylinder of said thruster means is formed integrally with said retainer.

6. A retarder as claimed in claim 5, wherein the piston of said thruster means is provided with a piston rod, said piston and rod forming said displaceable element.

7. A retarder as claimed in claim 6, wherein said piston rod is hollow and a tension spring is partly housed therein.

8. A retarder as claimed in claim 7, wherein said spring is secured at one end to the end of said piston rod remote from the piston and passes through said piston so that at its other end it is secured to an end wall of the cylinder at a point offset from the longitudinal axis of the cylinder.

9. A retarder as claimed in claim 1, wherein said thruster means is operable under fluid pressure.

10. A retarder as claimed in claim 9, wherein said fluid under pressure is compressed air.

11. A retarder, suitable when mounted upon or adjacent a rail of a railway track for reducing the speed of a wagon rolling along said track, comprising a hydraulic unit a portion of which, for retardation of said wagon, is disposed in the path of a wheel of said wagon, said portion when engaged, directly or indirectly, by a said wheel being deflected by, and out of the path of, said wheel to permit the wheel to pass the retarder, and thruster means, disposed alongside said unit and capable also of deflecting said portion out of said path, said thruster means having a displaceable element which is normally disengaged from said portion of said unit but which upon initial movement thereof, under a force applied thereto, is so tilted that a part thereof comes into driving engagement with said portion and on continued movement of said element said driving engagement is maintained and said portion is moved from its position in the path of said wheel into another position out of said path and including a retainer arranged for fitment to said rail; wherein said thruster means is of a piston-and-cylinder type, the cylinder of said thruster means is formed integrally with said retainer with its longitudinal axis inclined to the longitudinal axis of said hydraulic unit, the piston of said thruster means is provided with a piston rod, said piston and rod forming said displaceable element, and wherein the axis of said piston rod is parallel to, and substantially offset from, the longitudinal axis of said piston.

12. A retarder as claimed in claim 11, wherein the free end of said piston rod has an upstanding formation which forms said part capable of coming into driving engagement with said portion of said hydraulic unit.

13. A retarder as claimed in claim 12, wherein said upstanding formation is engageable with an annular groove formed in the exterior surface of said portion of said hydraulic unit.

14. A retarder, suitable when mounted upon or adjacent a rail of a railway track for reducing the speed of a wagon rolling along said track, including a hydraulic unit a portion of which, for retardation of said wagon, is disposed in the path of a wheel of said wagon, said portion when engaged, directly or indirectly, by a said wheel being deflected by, and out of the path of, said wheel to permit the wheel to pass the retarder, wherein truster means, of piston-and-cylinder type, is provided which is disposed alongside said unit with its longitudinal axis inclined to the longitudinal axis of that unit and which is capable also of deflecting said portion out of said path, said portion being formed with an annular groove in its exterior surface and said thruster means having a displaceable element, comprising a piston, a piston rod, and an upstanding formation carried upon the free end of said rod, which is normally disengaged from said portion of said unit but which upon initial movement thereof, under a force applied thereto, is so tilted that said upstanding formation comes into driving engagement with said annular groove, and on continued movement of said element said driving engagement is maintained and said portion is moved from its position in the path of said wheel into another position out of said path.

* * * * *